US008238593B2

(12) United States Patent
Bisgaard et al.

(10) Patent No.: US 8,238,593 B2
(45) Date of Patent: Aug. 7, 2012

(54) HEARING INSTRUMENT WITH ADAPTIVE DIRECTIONAL SIGNAL PROCESSING

(75) Inventors: Nikolai Bisgaard, Lyngby (DK); Rob Anton Jurjen De Vries, Tilburg (NL)

(73) Assignee: GN ReSound A/S, Ballerup (DK)

( * ) Notice: Subject to any disclaimer, the term of this patent is extended or adjusted under 35 U.S.C. 154(b) by 661 days.

(21) Appl. No.: 12/306,515

(22) PCT Filed: Jun. 25, 2007

(86) PCT No.: PCT/DK2007/000308

§ 371 (c)(1),
(2), (4) Date: Mar. 27, 2009

(87) PCT Pub. No.: WO2007/147418

PCT Pub. Date: Dec. 27, 2007

(65) Prior Publication Data

US 2011/0103626 A1 May 5, 2011

Related U.S. Application Data

(60) Provisional application No. 60/816,244, filed on Jun. 23, 2006.

(30) Foreign Application Priority Data

Jun. 23, 2006 (DK) ..... 2006 00852

(51) Int. Cl.
*H04R 25/00* (2006.01)

(52) U.S. Cl. ..... 381/313; 381/312; 381/320; 381/321

(58) Field of Classification Search ..... 381/312–331
See application file for complete search history.

(56) References Cited

U.S. PATENT DOCUMENTS

| | | | |
|---|---|---|---|
| 5,473,701 | A | 12/1995 | Cezanne et al. |
| 6,888,949 | B1 | 5/2005 | Vanden Berghe et al. |
| 6,983,055 | B2 | 1/2006 | Luo |
| 2001/0028718 | A1 | 10/2001 | Hou |

FOREIGN PATENT DOCUMENTS

| | | |
|---|---|---|
| EP | 1653768 | 10/2005 |
| WO | 01 72085 | 9/2001 |
| WO | 01 97558 | 12/2001 |

(Continued)

OTHER PUBLICATIONS

International Preliminary Report on Patentability for International Application No. PCT/DK2007/000308 dated Dec. 23, 2008.

(Continued)

*Primary Examiner* — Kenneth Parker
*Assistant Examiner* — John Lin
(74) *Attorney, Agent, or Firm* — Vista IP Law Group, LLP

(57) ABSTRACT

A hearing instrument includes a signal processor, and at least two microphones for reception of sound and conversion of the received sound into corresponding electrical sound signals that are input to the signal processor, wherein the signal processor is configured to process the electrical sound signals into a combined signal with a directivity pattern with at least one adaptive null direction θ, and wherein the signal processor is further configured to prevent the at least one null direction θ from entering a prohibited range of directions, wherein the prohibited range is a function of a parameter of the electrical sound signals.

24 Claims, 2 Drawing Sheets

FOREIGN PATENT DOCUMENTS

Figure 1:
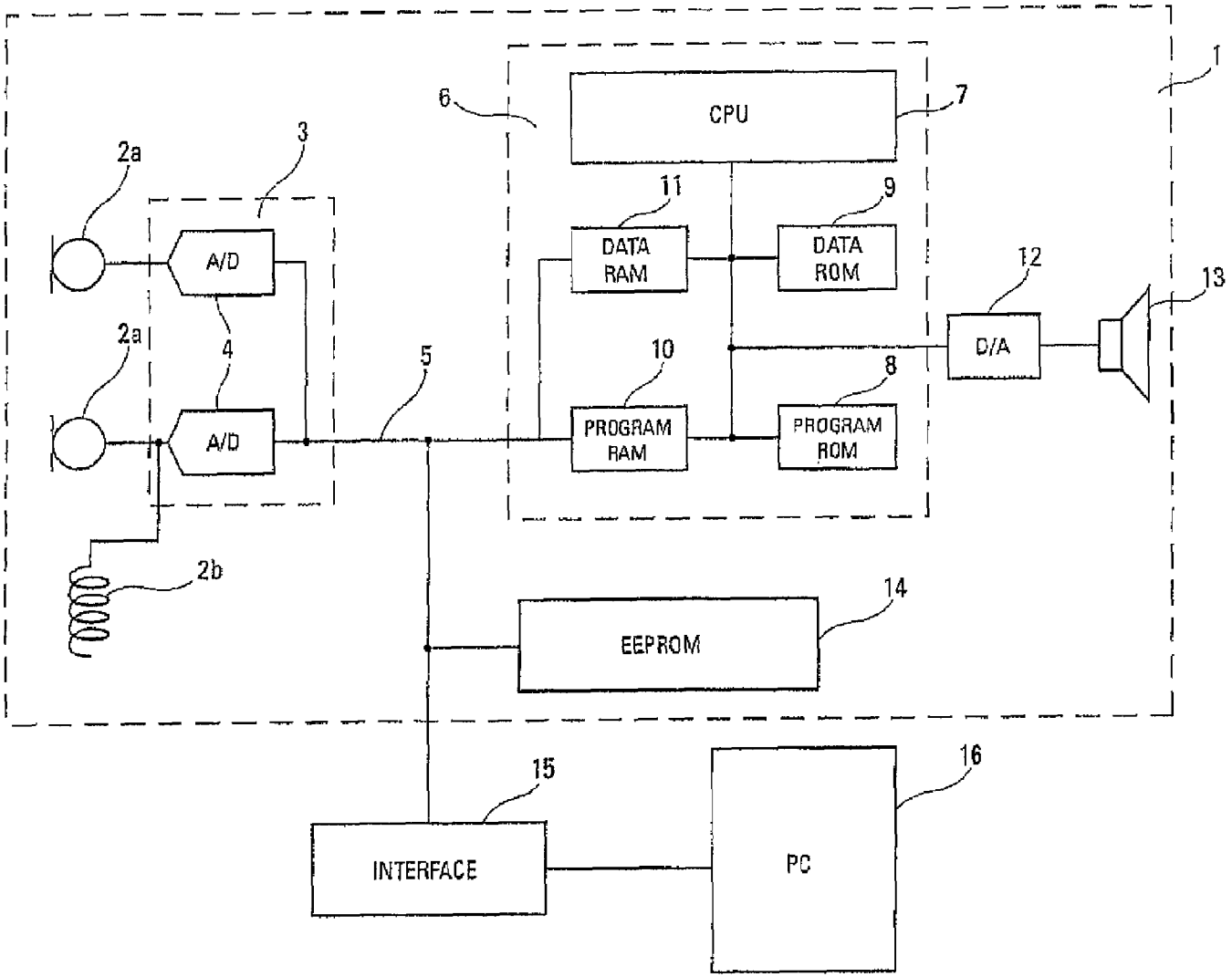

| | | |
|---|---|---|
| WO | 02 085066 | 10/2002 |
| WO | 2005 029914 | 3/2005 |
| WO | 2006 006935 | 1/2006 |

OTHER PUBLICATIONS

Written Opinion of the International Searching Authority for International Application No. PCT/DK2007/000308 dated Dec. 23, 2008.
International Search Report for International Application No. PCT/DK2007/000308 dated Oct. 22, 2007.
Chin, C.C. KO; "Tracking of Coherent Broadband Sources Using Adaptive Directional Filter with Maximally Flat Responses at Null Directions"; Signal Processing; 1996; pp. 31-54; vol. 55; Elsevier Science B.V.
Powers et al.: Proving Adaptive Directional Technology Works: A Review of Studies. Hearing Review-Apr. 2004.
Foreign Article.
High Performance Solution for Multiple Sound Scenes.
Donald Hayes, http://www.hearingreview.com/issues/articles/2004-09_06.asp, The Need for Fine-Tuning Adaptive Hearing Aids, Issue Stories, Hearing Review, The Hearing Industry Resource from the Hearing Review and Hearing Review Products, Sep. 2004, 4pgs.

HEARING INSTRUMENT WITH ADAPTIVE DIRECTIONAL SIGNAL PROCESSING

RELATED APPLICATION DATA

This application is the national stage of International Application No. PCT/DK2007/000308, filed on Jun. 25, 2007, which claims priority to and the benefit of Denmark Patent Application No. PA 2006 00852, filed on Jun. 23, 2006, and U.S. Provisional Patent Application No. 60/816,244, filed on Jun. 23, 2006, the entire disclosure of all of which is expressly incorporated by reference herein.

FIELD

The present application relates to a hearing instrument, such as a hearing aid, an implantable hearing prosthesis, a head set, a mobile phone, etc, with a signal processor for directional signal processing.

BACKGROUND

It is well-known to use information on the directions to sound sources in relation to a listener for distinguishing between noise sources and desired sound sources. Throughout the present specification, the term directional signal processing system means a signal processing system that is adapted to exploit the spatial properties of an acoustic environment. Directional microphones are available, but typically directional signal processing systems utilize an array of omni-directional microphones.

The directional signal processing system combines the electrical signals from the microphones in the array into a signal with varying sensitivity to sound sources in different directions in relation to the array. Throughout the present specification, a plot of the varying sensitivity as a function of the direction is denoted the directivity pattern. Typically, a directivity pattern has at least one direction wherein the microphone signals substantially cancel each other. Throughout the present specification, such a direction is denoted a null direction. A directivity pattern may comprise several null directions depending on the number of microphones in the array and depending on the signal processing.

Directional signal processing systems are known that prevent sound suppression of sources in certain directions of interest.

For example, U.S. Pat. No. 5,473,701 discloses a method of enhancing the signal-to-noise ratio of a microphone array with an adjustable directivity pattern, i.e. an adjustable null direction, for reduction of the microphone array output signal level in accordance with a criterion wherein the reduction is performed under a constraint that the null direction is precluded from being located within a predetermined region of space.

It is an object to provide a system with an improved capability of suppressing sound sources from all directions.

SUMMARY

According to the present application, the above-mentioned and other objects are fulfilled by a hearing instrument with at least two microphones for reception of sound and conversion of the received sound into corresponding electrical sound signals that are input to a signal processor, wherein the signal processor is adapted to process the electrical sound signals into a combined signal with a directivity pattern with at least one adaptive null direction θ. The signal processor is further adapted to prevent the at least one adaptive null direction θ from entering one or more prohibited ranges of directions, wherein each prohibited range is a function of a parameter of the electrical sound signals.

More than one prohibited range may for example occur in situations with more than one desired signal arriving from different directions.

Preferably, the at least two microphones are omni-directional microphones; however in some embodiments, some of the at least two microphones are substituted with directional microphones.

It is an important advantage that suppression of desired sound sources are avoided while undesired sound sources may still be suppressed from any arbitrary direction.

The hearing instrument may further comprise a desired signal detector for detection of desired signals, for example a speech detector for detection of presence of speech. Adjustment of the prohibited range of directions may be performed gradually over a first time interval when desired signals, such as speech, are detected after a period of absence of speech.

Further, adjustment of the prohibited range(s) of directions may be performed gradually over a second time interval when a desired signal, such as speech, stops after a period of presence of the desired signal, e.g. speech.

The prohibited range may include a predetermined direction, such as 0° azimuth or another preferred direction.

An estimate of the power of sound received by at least one of the at least two microphones may constitute the parameter, for example the averaged power of sound received by a front microphone may constitute the parameter, or the parameter may be a function of the estimate of the power of sound, e.g. the averaged power of sound.

An estimate of the signal to noise ratio of sound received by at least one of the at least two microphones may constitute the parameter, or the parameter may be a function of the estimate of the signal to noise ratio.

The hearing instrument may further comprise a desired signal detector, such as a speech detector, and a direction of arrival detector, and the prohibited range may include the detected direction of arrival of a detected desired signal, such as speech, whereby suppression of the desired signal, is prevented.

In an embodiment with a single prohibited range, the prohibited range may, in the presence of multiple desired signal sources, such as multiple speech sources, include the detected direction of arrival of the detected desired signal source closest to 0° azimuth, or another preferred direction.

In an embodiment with a single prohibited range, the prohibited range may, in the presence of multiple desired signal sources, such as speech sources, include the detected directions of arrival of all desired signal sources.

In an embodiment with a plurality of prohibited ranges, some or all of the prohibited ranges may be centered on respective detected directions of desired signal sources.

As explained for a single prohibited range, the width of a specific prohibited range of the plurality of prohibited ranges centered on the corresponding direction of the corresponding desired signal source may be controlled as a function of a parameter of the electrical sound signals, e.g. power, signal-noise ratio, etc.

A current null direction may reside inside the prohibited range(s) of directions upon adjustment of the prohibited range(s) of directions. The signal processor may further be adapted to move such a null direction outside the adjusted prohibited range(s).

The signal processor may be configured for subband processing whereby the electrical sound signals from the microphones are divided into a set of frequency bands B, and, in each frequency band B, or at least in some of the frequency bands B, the electrical sound signals are individually processed including:

(1) processing the electrical signals into a combined signal with an individual directivity pattern with an individually adapted null direction $\theta_i$, and (2) preventing the null direction $\theta_i$ from entering one or more prohibited ranges of directions, wherein each prohibited range is a function of a parameter of the electrical sound signals.

Subband processing allows individual suppression of undesired sound sources emitting sound in different frequency ranges.

The signal processor may be adapted to perform directional signal processing selected from the group consisting of an adaptive beam former, a multi-channel Wiener filter, an independent component analysis, and a blind source separation algorithm.

In accordance with some embodiments, a hearing instrument includes a signal processor, and at least two microphones for reception of sound and conversion of the received sound into corresponding electrical sound signals that are input to the signal processor, wherein the signal processor is configured to process the electrical sound signals into a combined signal with a directivity pattern with at least one adaptive null direction θ, and wherein the signal processor is further configured to prevent the at least one null direction θ from entering a prohibited range of directions, wherein the prohibited range is a function of a parameter of the electrical sound signals.

DESCRIPTION OF THE DRAWING FIGURES

Figure 2:
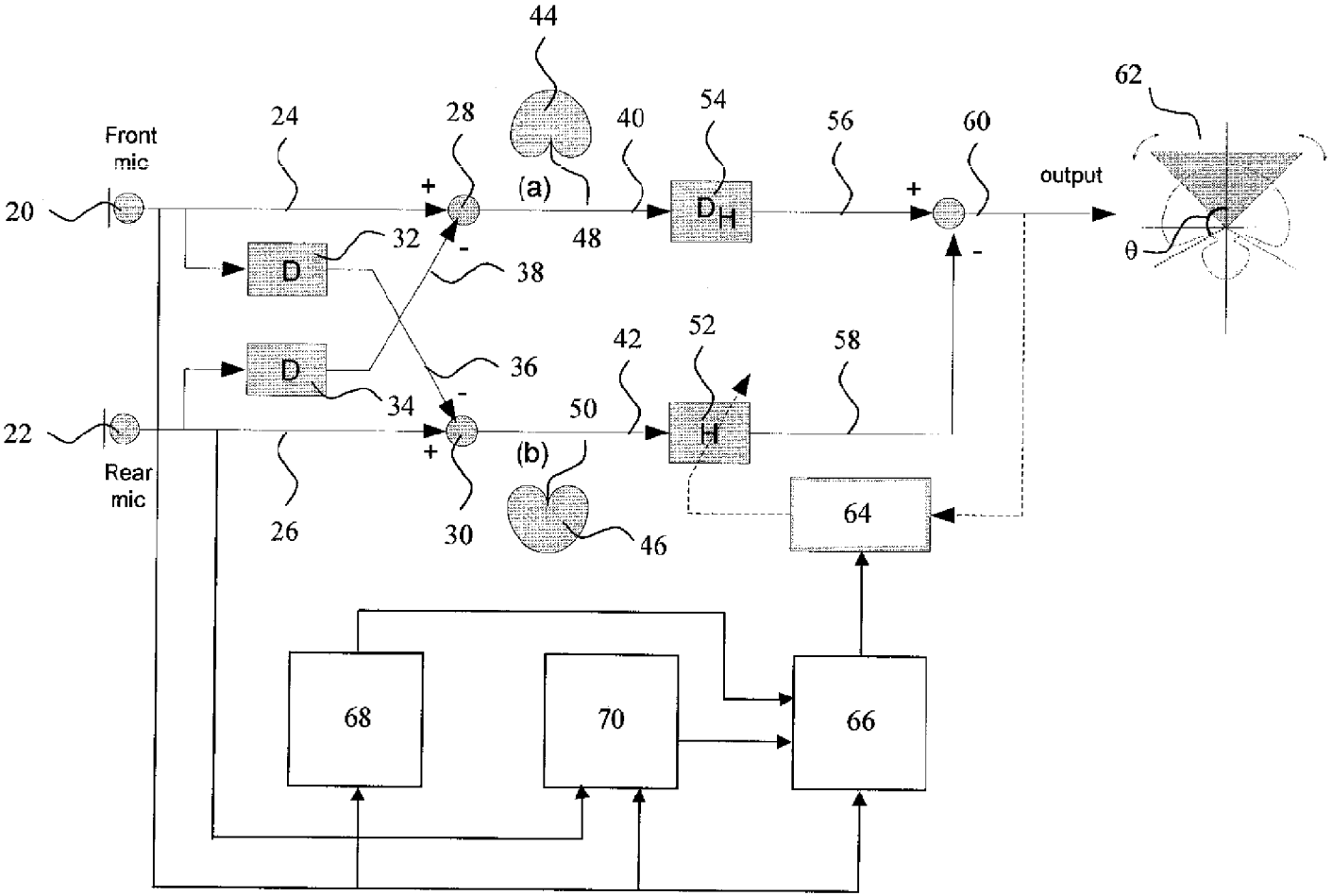

The above and other features and advantages will become more apparent to those of ordinary skill in the art by describing in detail exemplary embodiments thereof with reference to the attached drawings in which:

FIG. 1 shows a simplified block diagram of a digital hearing aid according to some embodiments, and FIG. 2 schematically illustrates the directional signal processing of the hearing aid of FIG. 1.

DETAILED DESCRIPTION

The embodiments will now be described more fully hereinafter with reference to the accompanying drawings. The claimed invention may, however, be embodied in different forms and should not be construed as limited to the embodiments set forth herein. Thus, the illustrated embodiments are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Like reference numerals refer to like elements throughout.

FIG. 1 shows a simplified block diagram of a digital hearing aid according to some embodiments. The hearing aid 1 comprises one or more sound receivers 2, e.g. two microphones 2*a* and a telecoil 2*b*. The analog signals for the microphones are coupled to an analog-digital converter circuit 3, which contains an analog-digital converter 4 for each of the microphones.

The digital signal outputs from the analog-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analog converter 12, from which analog output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus, can be provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which in some embodiments are used only in special cases, such as e.g. start-up programmes.

FIG. 2 schematically illustrates the signal processing of a hearing instrument according to some embodiments. The illustrated hearing instrument has two microphones 20, 22 positioned in a housing to be worn at the ear of the user. When the housing is mounted in its operating position at the ear of the user, one of the microphones, the front microphone 20, is positioned in front of the other microphone, the rear microphone 22, and a horizontal line extending through the front and rear microphones defines the front direction, i.e. azimuth=0°, corresponding to the looking direction of the user of the hearing instrument.

In another embodiment comprising a binaural hearing aid, the microphones 20, 22 may be positioned in separate housings, namely a housing positioned in the left ear and a housing positioned in the right ear of the user. The directional signal processing may then take place in either of the left or right hearing aid housings, or in both housing, or in a separate housing containing signal processing circuitry and intended to be worn elsewhere on the body of the user. The electrical signals may be communicated between the housings with electrical wires or wirelessly. The large distance between microphones in the left ear housing and the right ear housing may lead to a directivity pattern with a large directivity.

The microphones 20, 22 convert received sound signals into corresponding electrical sound signals that are converted into digital sound signals 24, 26 by respective A/D converters (not shown).

Each of the digitized sound signals 24, 26 is input to a respective subtraction circuit 28, and a respective delay 32, 34 with delay $D_H$. Each delay 32, 34 delays the digitized sound signal 24, 26 by the amount of time used by a sound signal to propagate in the 0° azimuth direction from the front microphone 20 to the rear microphone 22. Each subtraction circuit 28, 30 subtracts the respective delayed signal 36, 38 from one microphone 20, 22 from the direct signal 26, 24 of the other microphone 22, 20. Each of the subtracted signals 40, 42 has a fixed directional pattern 44, 46, a so-called cardioid pattern. The cardioid pattern 44 of the upper branch (a) has a null direction 48 at 180° azimuth, i.e. pointing in the rear direction of the user, and the cardioid pattern 46 of the lower branch (b) has a null direction 50 at 0° azimuth, i.e. pointing in the front direction of the user.

The subtracted signal 42 of the lower branch (b) is filtered by an adaptive filter 52 with a transfer function H, and the subtracted signal 40 of the upper branch (a) is delayed by a delay 54 with a delay $D_H$ equal to the group delay of the adaptive filter 52, and subsequently the two signals 56, 58 are subtracted for formation of a combined signal 60 with a directivity pattern 62 with an adaptive null direction θ. An example of a resulting directivity pattern 62 is also shown in FIG. 2. The hatched area of the resulting directivity pattern 62 illustrates the prohibited range of directions which in the illustrated example is symmetrical around 0° azimuth. The arched arrows indicate that the prohibited range of directions vary as a function of a parameter of the electrical sound signals.

It should be noted that in the illustrated embodiment of FIG. 2, the delay 34 and the subtraction circuit 28 may be omitted and still an output 60 with a directional pattern 62 similar to the illustrated embodiment of FIG. 2 may be obtained due to corresponding changes in the operation of the adaptive filter 52.

Further, both delays 32, 34 and subtraction circuits 28, 30 may be omitted in the illustrated embodiment of FIG. 2, and still an output 60 with a directional pattern 62 similar to the illustrated embodiment of FIG. 2 may be obtained due to corresponding changes in the operation of the adaptive filter 52.

In the illustrated embodiment, the filter 52 is configured to minimize the output power of the combined signal 60 by the filter coefficient update circuit 64. The filter 52 may be a finite impulse response (FIR) filter with N taps.

The adaptive filter controller 66 prevents the null direction θ from entering a prohibited range of directions as a function of a parameter of the electrical sound signals.

The adaptive filter controller 66 constrains the filter coefficients of the adaptive filter 52 in such a way that a directional null θ remains outside the prohibited range of directions.

For example, the adaptive filter 52 may have a single tap in which case the adaptive filter 52 is an amplifier with a gain $G_H$, and the adaptive filter controller 66 constrains the gain $G_H$ to remain inside the range $0 \leqq G_H \leqq G_{limit}$. The value of the threshold $G_{limit}$ determines the prohibited range of directions. For example, when $G_{limit}=1$, the prohibited range of directions ranges from −90° azimuth to +90° azimuth.

The adaptive filter controller 66 may freeze the filter coefficients, i.e. updating of the filter coefficients may be stopped temporarily, when the strongest sound source is located within the prohibited range of directions. This approach requires estimation of the direction of arrival (DOA) of the signal incident on the hearing instrument.

A DOA estimate may be obtained by determination of an M point auto-correlation A of the front microphone signal 24 delayed by D and determination of an M point cross-correlation B of the front microphone signal 24 delayed by D and the rear microphone signal 26:

$$A = \sum_{i=0}^{M-1} (\text{front}(k - D - i))^2 \tag{1}$$

$$B = \sum_{i=0}^{M-1} \text{front}(k - D - i)\text{rear}(k - i) \tag{2}$$

β=B/A can be used as an estimate of the direction of arrival of the dominant sound in the acoustic environment. When β=B/A=1, the DOA is 0°. As β decreases toward 0, the DOA moves towards 180° azimuth. Thus, the adaptation may be temporarily stopped when $$\beta > \sigma \tag{3}$$

where σ is determined in such a way that β=B/A=σ when the DOA of e.g. a zero mean white noise source is a degrees azimuth, the prohibited range of directions extending from −α degrees azimuth to a degrees azimuth including 0° azimuth.

It should be noted that with this DOA estimate, the prohibited range of directions will be frequency dependent, because the value of β=B/A is both dependent on the direction of arrival and on the frequency of the signal. In some embodiments, with subband processing with individual beamforming in each frequency band $B_i$, individual thresholds a may be defined for each frequency band $B_i$.

The person skilled in the art will recognize that numerous other conventional methods are available to obtain an estimate of the DOA, including frequency independent estimates.

The signal processing is not necessarily done on the same apparatus that contains (one or more of) the microphones. The signal processing may be performed in a separate device that is linked to the, possibly multiple apparatuses that contain the microphones via a wire, wireless or other connection.

In the following various examples are described of determining the prohibited range of directions as a function of a parameter of the electrical sound signals. In the examples, −α till α degrees azimuth constitutes the prohibited range of directions including 0° azimuth.

In some embodiments, the prohibited range of directions is a function of the short term average power $P_F$ (e.g. over the past 10 seconds) of the electrical signal 24 from front microphone 20 in accordance with $$\alpha = \alpha_{max}\left(1 - \frac{\max(P_{min}, \min(P_F, P_{max})) - P_{min}}{P_{max} - P_{min}}\right) \tag{4}$$

Hence, the prohibited range of directions narrows when the signal power $P_F$ increases and for $P_F > P_{max}$ α=0° (front direction) and for $P_F < P_{min}$ $\alpha = \alpha_{max}$.

The values of $\alpha_{max}$, $P_{min}$, and $P_{max}$ may be set during manufacture of the hearing instrument, or, during a fitting session of the hearing instrument with the intended user.

In one example, $P_{min}$=45 $dB_{SPL}$ and $P_{max}$=110 $dB_{SPL}$. It should be noted that very loud sounds (above 110 $dB_{SPL}$) may be suppressed from any direction providing protection against harmful sounds (e.g. when getting too close to a loudspeaker at a concert). For $\alpha_{max}$=180°, an omni-directional pattern is obtained in relative quiet environments below 45 $dB_{SPL}$.

In other embodiments, the prohibited range of directions is a function of the signal-to-noise ratio SNR for the signal 40 at point (a) in FIG. 2 in accordance with $$\alpha = \alpha_{max}\frac{\max(SNR_{min}, \min(SNR, SNR_{max})) - SNR_{min}}{SNR_{max} - SNR_{min}} \quad (5)$$

Hence, the prohibited range of directions narrows when the signal-to-noise ration SNR increases and for SNR>$SNR_{max}$, $\alpha=\alpha_{max}$ and for SNR<$SNR_{min}$, $\alpha$=0° (front direction).

The values of $\alpha_{max}$, $SNR_{min}$, and $SNR_{max}$ may be set during manufacture of the hearing instrument, or, during a fitting session of the hearing instrument to the intended user.

SNR may be estimated utilizing a speech detector 68, e.g. a modulation or speech probability estimator, or a modulation or speech activity detector, to detect presence of speech and calculate the average power $P_X$ of the signal when speech is present. The average noise power $P_N$ in absence of speech is estimated using a minimum statistics approach. An estimate of the SNR is then given by $$SNR = 20\log_{10}\left(\frac{P_X - P_N}{P_N}\right) \text{ dB} \quad (6)$$

In some embodiments, the prohibited range of directions is a function of the azimuth direction of speech $\beta$. Presence of speech is detected by the speech detector 68 that processes the signal 24 and the direction of arrival $\beta$ is estimated by the direction of arrival detector 70, and the prohibited range of directions is adjusted to include $\beta$. $\beta$ may change due to head or speaker movement. In the presence of multiple speech sources, the prohibited range of directions may be adjusted to include DOA of the speech source closest to 0° azimuth or to include DOAs of all detected speech sources.

The above-mentioned approaches may be combined.

For example, in some embodiments, the prohibited range of directions is a function of the short term average power $P_F$ (e.g. over the past 10 seconds) of the electrical signal 24 from front microphone 20 in accordance with $$\alpha = \alpha_{max} - \frac{\max(P_{min}, \min(P_F, P_{max})) - P_{min}}{P_{max} - P_{min}}(\alpha_{max} - \alpha_{snr}) \quad (7)$$

which is similar to equation (4) above with the exception that a varies between $\alpha_{max}$ and $\alpha_{snr}$ in equation (7) while a varies between $\alpha_{max}$ and 0° in equation (4), and wherein $$\alpha_{snr} = \alpha_{min} + \frac{\max(SNR_{min}, \min(SNR, SNR_{max})) - SNR_{min}}{SNR_{max} - SNR_{min}}(180 - \alpha_{min}) + \frac{\max(SNR_{lowthld}, \min(SNR, SNR_{low})) - SNR_{low}}{SNR_{lowthld} - SNR_{low}}(180 - \alpha_{min}) \quad (8)$$

and $$\alpha_{min} = DOA_{max} \quad (9)$$

wherein

SNR is the estimated signal-to-noise ratio at point (a) in FIG. 1 over the past 10 seconds, e.g. obtained as described above, $SNR_{short}$ is the estimated signal-to-noise ratio at point (a) in FIG. 1 over the past 0.05 seconds, e.g. obtained as described above, $SNR_{shortmax}$ is the maximum value of $SNR_{short}$ over the past 10 seconds, and $DOA_{max}$ is the average value of the DOA over the 0.05 seconds block that resulted in $SNR_{shortmax}$.

For example, $P_{max}$=60 $dB_{SPL}$, $P_{min}$=45 $dB_{SPL}$, $SNR_{min}$=5 dB, $SNR_{max}$=15 dB, $SNR_{low}$=−10 dB, $SNR_{lowthid}$=−20 dB, and $\alpha_{max}$=180°.

It should be noted that in this embodiment the prohibited range of directions is as narrow as possible around the direction to the speech source with the highest SNR. The prohibited range increases when the overall SNR is larger than the threshold $SNR_{min}$ or smaller than the threshold $SNR_{low}$, and saturates into an omni-directional pattern when the SNR is larger than the threshold $SNR_{max}$ (e.g. when there is no noise) or lower than the threshold $SNR_{lowthid}$ (e.g. when there is no speech), or the overall signal power $P_F$ is smaller than the threshold $P_{max}$, and also saturates into an omni-directional pattern when $P_F$ is smaller than the threshold $P_{min}$ (e.g. in quiet surroundings).

Preferably, timing restrictions are also included in accordance with some embodiments so that frequent and abrupt changes of the prohibited range of directions are avoided.

For example the prohibited range of directions may be prevented from narrowing in response to a short term presence of a noise source, such as reception of reverberations. Short term presence may be defined as presence during less than 0.1 seconds.

An adjustment of the prohibited range of directions may be performed gradually in a time interval when speech stops after a period of presence of speech. For example, a may be gradually increased to $\alpha_{max}$ in a time interval of about 3 seconds. Throughout the present specification, presence or absence of speech refer to the detection or non-detection of speech, respectively, of the system.

A speech stop may be defined as the moment that no speech has been detected for e.g., 5 seconds, and a conversation stop may be defined as the moment that no speech has been detected for e.g., 30 seconds. Speech start and conversation start may be defined as the moment that speech is detected for the first time after a speech stop and a conversation stop, respectively.

A long term average may be defined as the average over e.g., 2 seconds. A short term average may be defined as the average over e.g., 50 milliseconds.

In some embodiments, the prohibited range of directions is adjusted upon start of conversation according to the following:

Calculation of the long term average DOA value during speech presence is performed; typically the calculation requires 2 seconds of speech presence.

Provided that the long term average DOA value during speech presence is not significantly different from the long term average DOA value during speech absence, $\alpha$ is increased to $\alpha_{max}$ with the release time, e.g. in about 3 seconds. (This situation occurs when e.g. the noise and speech arrive from the same direction, in which case beamforming is not advantageous, or when the speaker is outside the Hall radius and the perceived noise field is diffuse, or when the SNR is low.)

Provided that the long term average DOA value during speech presence is significantly different from the long term average DOA value during speech absence, the prohibited range of direction is adjusted in accordance with the following:

When the short term average DOA value during speech presence remains above or around e.g. 80°, $\alpha$ is increased to $\alpha_{max}$ in about 3 seconds. (In this case the listener is apparently not interested enough in the speech to turn his head, or he is e.g. driving a car and can not turn his head to the speaker.)

When the short term average DOA value during speech presence does become significantly lower than 80°, the prohibited range of directions is adjusted to just include the minimum of the short term average DOA value over e.g. the past 2 seconds, plus a safety margin of about 20° in order to take head movements into a account. This is repeated until speech stop. Upon speech stop, $\alpha$ is adjusted to e.g. $\phi_{max}$+20°, where $\phi_{max}$ is equal to the maximum of the short term average DOA values measured at a speech start over e.g. the last 3 speech start events. (This prevents the user from missing any of the speech of interest, while a narrow beam is also obtained when the user has focused on the speaker. A situation like this can occur when the user is in a restaurant and is alternatively looking at the plate and at the person next or opposite to the user.)

In the above example, preferably $\alpha_{max}$ is 180° so that an omni-directional pattern is obtained when $\alpha$ is increased to $\alpha_{max}$, since the omni-directional pattern imparts a perception to the user of being connected to the environment.

$\alpha_{max}$ equal to 90° may be selected to maintain directional suppression in the back region of the user.

The prohibited range of directions may be broadened to such an extent that an existing null direction $\theta$ ends up residing within the prohibited range.

According to an aspect of some of the embodiments, the signal processor is adapted to move a null direction $\theta$ residing within a prohibited range for a certain time period, e.g. 1 second, or 10 seconds, outside the prohibited range. This may be done momentarily or over a period of time.

A null position monitor may be provided for monitoring the current null position. When the current null position resides within the adapting prohibited range of directions for more than, e.g., 1 second, the signal processor moves the null outside the prohibited range of directions.

An estimate of the current null position may be obtained by averaging the direction of arrival during adaptation. When the rate of change of this average is similar to the rate of adaptation of the null, the average will be a good estimate of the current null position.

The null may be moved outside the prohibited range of directions in many ways. For example, when the null resides within the prohibited range of directions for more than, e.g., 1 second, the adaptive filter H may be re-initialized so that the null is positioned outside the prohibited range of directions. The re-initialization filter coefficients may be read from a table holding previously performed measurements or determinations of filter coefficients that position the null at, e.g., 0, 10, 20, . . . etc degrees. In another embodiment, the filter coefficients are calculated when needed.

The changed position of the null may be selected in different ways. For example, the changed position may be selected to reside as close as possible to its previous position, but outside the prohibited range of directions. In another embodiment, the changed position is selected at the location that has the greatest distance from all prohibited ranges of directions that are currently in effect.

For example, the adaptive filter may be forced to position the null direction at $\theta$=180° and continue adaptation from this value. e.g., the coefficients of the adaptive filter 52 may be reset to values that position the null direction at $\theta$=180°. In another example wherein the cost function that H minimizes is equal to the output power, a weighted bias term is added to the cost function that forces H to position the directional null at 180°. When the null has moved outside the prohibited range of directions, the normal adaptation is resumed.

A value of $\alpha$ to 180° indicates that an omni-directional pattern is desired. An omni-directional pattern may be obtained by processing the output 60 in accordance with:

$$z(k)=y(k)+(1-\lambda)(x(k)-y(k)) \tag{10}$$

wherein y is the output 60, x is the output 24 of the front microphone 20, and k is the current sample number. z is the processed output.

Hence, when $\lambda$ equals zero, z is equal to x, i.e. an omni-directional pattern is provided, and when $\lambda$ equals 1, z is equal to the original directional output 60. By varying $\lambda$ between 0 and 1, the directional pattern changes gradually from the original directional output 60 to an omni-directional output. Thus, when a gets equal to 180°, $\lambda$ is decreased to 0 in e.g. 10 seconds and when $\alpha$ becomes smaller than 180° $\lambda$ is increased towards 1 in e.g. 3 seconds.

Although particular embodiments have been shown and described, it will be understood that they are not intended to limit the present inventions, and it will be obvious to those skilled in the art that various changes and modifications may be made without departing from the spirit and scope of the present inventions. For example, any of the processor (such as the signal processor) described herein may be implemented using one or more processing units, wherein each of the units may itself be considered a processor (e.g., a signal processor). Thus, as used in this specification, the term "processor" (as in "signal processor") is not limited to a single processor, and may refer to a plurality of processors (e.g., different processors in different housings, etc.). The specification and drawings are, accordingly, to be regarded in an illustrative rather than restrictive sense. The claimed inventions are intended to cover alternatives, modifications, and equivalents.

The invention claimed is:

1. A hearing instrument, comprising:

a signal processor; and at least two microphones for reception of sound and conversion of the received sound into corresponding electrical sound signals that are input to the signal processor;

wherein the signal processor is configured to process the electrical sound signals into a combined signal with a directivity pattern with at least one adaptive null direction $\theta$; and wherein the signal processor is further configured to prevent the at least one null direction $\theta$ from entering a prohibited range of directions, wherein the prohibited range is a function of a parameter of the electrical sound signals.

2. The hearing instrument according to claim 1, wherein the prohibited range includes a predetermined direction.

3. The hearing instrument according to claim 1, wherein the parameter comprises at least a power estimate of sound received by at least one of the at least two microphones.

4. The hearing instrument according to claim 1, wherein a power estimate of sound received by at least one of the at least two microphones constitutes the parameter.

5. The hearing instrument according to claim 1, wherein the parameter comprises at least an estimate of a signal to noise ratio of sound received by at least one of the at least two microphones.

6. The hearing instrument according to claim 1, wherein an estimate of a signal to noise ratio of sound received by at least one of the at least two microphones constitutes the parameter.

7. The hearing instrument according to claim 1, further comprising a detector for detecting a desired signal, wherein the processor is further configured to adjust the prohibited range of directions in a time interval when the detector detects the desired signal after a period of absence of the desired signal.

8. The hearing instrument according to claim 1, further comprising a detector for detecting a desired signal, wherein the processor is further configured to adjust the prohibited range of directions in a time interval when the detector cannot detect the desired signal after a period of presence of the desired signal.

9. The hearing instrument according to claim 1, further comprising a first detector for detecting a desired signal, and a second detector for detecting a direction of arrival of the detected desired signal, wherein the prohibited range includes the detected direction of arrival of the detected desired signal.

10. The hearing instrument according to claim 9, wherein the detected direction of arrival of the detected desired signal is from a source that is closest to 0° azimuth.

11. The hearing instrument according to claim 9, wherein the prohibited range includes one or more additional detected direction(s) of arrival of detected desired signal(s) from one or more sound source(s), respectively.

12. The hearing instrument according to claim 9, wherein the first detector comprises a speech detector and the desired signal comprises a speech.

13. The hearing instrument according to claim 1, wherein the signal processor is further configured to move a current null direction outside an adjusted prohibited range.

14. The hearing instrument according to claim 1, wherein the signal processor is configured to move the at least one null direction θ outside the prohibited range of directions.

15. The hearing instrument according to claim 1, wherein the signal processor is configured for subband processing.

16. The hearing instrument according to claim 15, wherein in the subband processing, the electrical sound signals from the microphones are divided into a set of frequency bands $B_i$, and in at least one of the frequency bands $B_i$, the electrical sound signals are processed into a combined signal with an individual directivity pattern having an individually adapted null direction $\theta_i$.

17. The hearing instrument according to claim 1, wherein the signal processor is configured to perform directional signal processing using an adaptive beam former, a multi-channel Wiener filter, an independent component analysis, or a blind source separation algorithm.

18. A hearing instrument, comprising:

a signal processor;

at least two microphones for reception of sound and conversion of the received sound into corresponding electrical sound signals that are input to the signal processor;

wherein the signal processor is configured to:

process the electrical sound signals into a combined signal with a directivity pattern with at least one adaptive null direction θ, move the at least one null direction θ outside a prohibited range of directions, and prevent the at least one null direction θ from entering the prohibited range of directions.

19. The hearing instrument according to claim 18, further comprising a detector for detecting a desired signal, wherein the processor is further configured to adjust the prohibited range of directions in a time interval when the detector detects the desired signal after a period of absence of the desired signal.

20. The hearing instrument according to claim 18, further comprising a detector for detecting a desired signal, wherein the processor is further configured to adjust the prohibited range of directions in a time interval when the detector cannot detect the desired signal after a period of presence of the desired signal.

21. The hearing instrument according to claim 18, further comprising a first detector for detecting a desired signal, and a second detector for detecting a direction of arrival of the detected desired signal, wherein the prohibited range includes the detected direction of arrival of the detected desired signal.

22. The hearing instrument according to claim 21, wherein the detected direction of arrival of the detected desired signal is from a source that is closest to 0° azimuth.

23. The hearing instrument according to claim 21, wherein the prohibited range includes one or more additional detected direction(s) of arrival of detected desired signal(s) from one or more sound source(s), respectively.

24. The hearing instrument according to claim 21, wherein the first detector comprises a speech detector and the desired signal comprises a speech.

* * * * *